US005244859A

United States Patent [19]

Tran et al.

[11] Patent Number: 5,244,859

[45] Date of Patent: Sep. 14, 1993

[54] THERMAL VELLUM PAPER

[75] Inventors: Cuong Tran, North Hollywood; Akira Ichikawa; H. Ono, both of Irvine, all of Calif.

[73] Assignee: Ricoh Electronics, Inc., Santa Ana, Calif.

[21] Appl. No.: 940,185

[22] Filed: Sep. 3, 1992

[51] Int. Cl.[5] ..... B41M 5/40

[52] U.S. Cl. ..... 503/200; 427/150; 427/152; 403/226

[58] Field of Search ..... 503/200, 226; 428/537.5; 427/150–152

[56] References Cited

FOREIGN PATENT DOCUMENTS 151294 9/1983 Japan ..... 503/200

*Primary Examiner*—Pamela R. Schwartz

*Attorney, Agent, or Firm*—Walter A. Hackler

[57] ABSTRACT

A thermal vellum medium includes a wood pulp based substrate having a thermal layer, comprising a heat-sensitive, image-forming material disposed on one side thereof and a silicone layer impregnated into an opposite side of the substrate.

8 Claims, No Drawings

THERMAL VELLUM PAPER

Vellum media has been important in the areas of reprographic technology, particularly as it is applied to engineering fields.

For many years, drawings have been prepared on a translucent medium so copies of the drawings may be made by a number of processes, including the blueprint (diazo) process which utilizes transmitting ultraviolet light.

Because of the common use of the translucent media, the term "vellum" has been adopted for paper which has been impregnated with oils or resins to render it translucent. Heretofore, such paper has comprised 100% rag or cotton. While rag or cotton base papers have long been used, they do not provide an optimum smooth surface as is desirable for vellums, and further, the translucent properties of the paper provided by the impregnation of oil or resin therewith often migrated from the vellum paper into adjacent materials. In addition, such oil-impregnated vellums did not accept drafting inks in a consistent manner.

Further, with the heretofore available vellum media, corrections by way of erasures on the vellum impregnated with oils and/or resins were not easily made. This was due to the fact that ink partially impregnated into the substrate and therefore made erasing of images thereon and/or corrections difficult.

The present invention is directed to a thermal vellum media, or paper, in which a layer of thermosensitive coloring material is disposed on a substrate. In use, a thermohead printer, or the like, is contacted with the thermal vellum in order to cause color formation, thereby creating images in the layer. Since the substrate is translucent, the images created thereon may be utilized for making copies, for example, by the diazo process.

SUMMARY OF THE INVENTION

Thermal vellum media, in accordance with the present invention, generally includes a wood pulp base substrate and a thermal layer comprising a heat-sensitive, image-forming material disposed on one side of the substrate. The use of the wood pulp base substrate, rather than the rag or cotton base substrate, results in a media having a much smoother surface.

A silicone layer is impregnated into an opposite side of the substrate in an amount causing the substrate to have a transparency of at least about 30%.

Generally suitable silicones include synthetic polymers having the formula ($R_nSiO_{(4-n)/2m}$) wherein $n=1-3$ and $m \geqq 2$ and R is methyl, longer alkyl, fluoroalkyl, phenyl or vinyl. These polymers may be combined with fillers, additives and solvents.

Further, the silicone layer may have a weight of between about 5 grams per square meter to about 15 grams per square meter.

The method for producing a thermal vellum medium in accordance with the present invention generally includes the step of applying a thermal layer comprising a heat-sensitive, image-forming material on one side of the substrate and thereafter applying a silicone layer to an opposite side of the substrate, in an amount causing the substrate to have a transparency of at least 30%. This method is distinguished from prior art techniques in producing thermal media in which the thermal layer is applied to a translucent substrate, the latter already having been impregnated with an oil or resin.

In the method of the present invention, the silicone layer is applied at a temperature less than a temperature necessary to cause image formation in the layer, specifically the temperature of application is preferably between about 130° F. and about 150° F. More specifically, in order to form a substrate having a transparency of at least 30%, the silicone layer is applied with a coating weight of between about 5 grams per square meter to about 15 grams per square meter.

The present invention thus particularly includes a thermal vellum medium made by applying a thermal layer comprising a heat-sensitive, image-forming material onto one side of the substrate and thereafter applying a silicone layer onto another side of the substrate. In accordance with the hereinabove recited method, in accordance with the present invention, the resulting thermal vellum medium includes a silicone layer in an amount to cause the substrate to have a transparency of at least about 30% when the substrate comprises a wood pulp.

DETAILED DESCRIPTION

As hereinabove set forth, the present invention has particular advantage in the use of a wood pulp base paper, rather than a more expensive, 100% rag or cotton base paper or substrate. Such a substrate may have an original transparency of up to 16% and have a weight of about 30 grams/sq. meter to about 100 grams/sq. meter.

First, a thermal layer, comprising a heat-sensitive, image-forming material is coated, or disposed, on one side of the substrate. Such coatings and techniques of application are well known in the art, as, for example, described and set forth in U.S. Pat. Nos. 4,577,204, 4,370,370, 4,424,245, 4,388,362, and 4,401,721, and many others. These particular references are incorporated herewith by specific reference thereto for a description of typical thermal layers which may be adapted and utilized in the present invention. The amount and thickness of the thermal layer may be selected in accordance with well-known principles in order to produce a suitable image upon application of heat. The thermal layer may include one or more protective layers, as is well-known in the art, for enhancing image production and/or protecting the silicone layer, as is well-known in the art.

As a specific example, suitable materials for the thermal layer may include a leuco dye or metallic salt in combination with an acetic material capable of coloring the leuco dye or metallic salt when heat is applied.

Application of the thermal layer may be accomplished using any standard web application methods that are normally used for coating operations.

Importantly, the silicone layer utilized to transparentize the substrate is applied after the substrate is coated with the thermal layer. This procedure enables the silicone to absorb more easily into the paper and thereby inhibit such a silicone layer from being peeled off. A suitable silicone in liquid may be one or a combination of well-known release polymers, crosslinking polymers and dehesive silicone such as methylvinylsiloxane.

Specific examples of silicone compositions include the following:

| | Transparency |
|---|---|
| Example 1: | |
| SYL-OFF 7600: 107.5 g<br>SYL-OFF 7602: 12.0 g<br>SYL-OFF 7601: 6.1 g | 40% |
| Example 2: | |
| SYL-OFF 7678 100% | 36% |
| Example 3: | |
| SYL-OFF 7781 modifier: 19.52 g<br>SYL-OFF 7675 release coating: 2.18 g<br>SYL-OFF 7678 cros-linker: 1.08 g | 40% |
| Example 4: | |
| SYL-OFF 7601 cross-linker 100% | 35% |
| Example 5: | |
| Cross-linker 1524 100% | 35% |
| Example 6: | |
| SYL-OFF cross-linker: 3.05 g<br>Silicone oil: 6 g | 35% |

These products are available from Dow Corning Corp. of Midland, Mich., and Wacker Silicone Corp. of Adrian, Mich.

It has been found that compositions in accordance with the hereinabove set forth examples applied to impregnate in a substrate in amounts of about 5 grams per square centimeter to about 15 grams per square centimeter enable the substrate to obtain a transparency of between 30% and 50%.

As hereinabove described in connection with the application of the thermal layer, the silicone may be applied to the substrate in any conventional manner, using a doctor blade or like.

In particular, the resulting product based on the wood pulp substrate provides a very smooth, even-surfaced paper which provides the formation of sharp images in the thermal layer, thus resulting in a vellum capable of producing more distinct copies through reproduction, as, for example, diazo process, than is available from rag or cotton base substrate vellum materials.

Although there has been hereinabove described a specific arrangement of a thermal vellum medium and method for manufacture thereof, in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. Thermal vellum media comprising:
   a wood pulp base substrate;
   a thermal layer comprising a heat-sensitive, image-forming material disposed on one side of said substrate; and
   a silicone layer impregnated into an opposite side of said substrate in an amount causing the wood pulp base substrate to have a transparency of at least about 30 percent.

2. The thermal vellum media according to claim 1 wherein the silicone layer has a weight between about 5 grams/sq. meter to about 15 grams/ sq. meter.

3. A thermal vellum medium made by applying a thermal layer comprising a heat-sensitive, image-forming material into one side of a wood pulp base substrate and thereafter applying a silicone layer onto another side of said substrate in an amount causing the wood pulp base substrate to have a transparency of at least about 30 percent.

4. The thermal vellum media according to claim 3 wherein the silicone layer has a weight between about 5 grams/sq. meter and 15 grams/sq. meter.

5. A method for producing a thermal vellum medium, said method comprising the steps of:
   applying a thermal layer comprising a heat-sensitive, image-forming material to one side of a wood pulp base substrate; and
   applying a silicone layer to an opposite side of said substrate in an amount causing the substrate to have a transparency of at least 30 percent.

6. The method according to claim 5 wherein the silicone layer is applied at a temperature less than a temperature necessary to cause image formation in said thermal layer.

7. The method according to claim 6 wherein the silicone layer is applied at a temperature of between about 130° F. and about 150° F.

8. The method according to claim 5 wherein the silicone layer is applied with a coating weight of between about 5 grams/sq. meter to about 15 grams/sq. meter.

* * * * *